US007169013B2

(12) United States Patent
Mizuno et al.

(10) Patent No.: US 7,169,013 B2
(45) Date of Patent: Jan. 30, 2007

(54) EYEGLASS LENS PROCESSING APPARATUS

(75) Inventors: Toshiaki Mizuno, Gamagori (JP); Kyoji Takeichi, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/412,876

(22) Filed: Apr. 28, 2006

(65) Prior Publication Data

US 2006/0264154 A1 Nov. 23, 2006

(30) Foreign Application Priority Data

Apr. 28, 2005 (JP) ..... P2005-133734

(51) Int. Cl.
*B24B 49/00* (2006.01)

(52) U.S. Cl. ..... 451/5; 451/42

(58) Field of Classification Search ..... 451/5, 451/8, 42–44, 240, 255, 256, 277, 323
See application file for complete search history.

(56) References Cited

U.S. PATENT DOCUMENTS

| | | | | |
|---|---|---|---|---|
| 5,333,412 | A | 8/1994 | Matsuyama | |
| RE35,898 | E | 9/1998 | Shibata et al. | |
| 6,261,150 | B1 * | 7/2001 | Mizuno et al. | 451/5 |
| 6,579,155 | B1 * | 6/2003 | Luderich et al. | 451/43 |
| 2002/0115381 | A1 * | 8/2002 | Mizuno et al. | 451/9 |
| 2004/0192170 | A1 * | 9/2004 | Mizun | 451/5 |

FOREIGN PATENT DOCUMENTS

| | | | |
|---|---|---|---|
| EP | 0 839 604 | A1 | 5/1998 |
| EP | 0 968 790 | A2 | 1/2000 |
| EP | 1 464 443 | A1 | 10/2004 |
| JP | 4-93164 | A | 3/1992 |
| JP | 5-212661 | A | 8/1993 |
| JP | 2004-255561 | A | 9/2004 |

* cited by examiner

*Primary Examiner*—Dung Van Nguyen
(74) *Attorney, Agent, or Firm*—Sughrue Mion, PLLC

(57) ABSTRACT

An eyeglass lens processing apparatus includes: a lens rotating unit having lens chucking shafts which hold an eyeglass lens, and a first motor which rotates the chucking shafts; an axis-to-axis distance changing unit having a second motor which changes an axis-to-axis distance between a center axis of rotation of a processing tool which processes a periphery of the lens and a center axis of rotation of the chucking shafts; a torque detector which directly or indirectly detects torque transmitted to the chucking shafts; a torque level setting unit which variably sets an allowable torque level; and a driving controller which controls at least one of driving of the first motor and driving of the second motor to adjust at least one of a rotational speed of the chucking shafts and a processing pressure of the lens so that the torque falls below the allowable torque level.

5 Claims, 6 Drawing Sheets

EYEGLASS LENS PROCESSING APPARATUS

BACKGROUND OF THE INVENTION

The present invention relates to an eyeglass lens processing apparatus which processes an eyeglass lens.

In an eyeglass lens processing apparatus, an eyeglass lens is rotated while being held (chucked) by two lens chucking shafts, and the periphery of the lens is processed by a processing tool such as a grindstone so as to substantially conform to a desired target lens shape. The holding of the lens is performed by fixedly attaching a cup serving as a fixture to the rear refractive surface of the lens by suction, adhesion, or the like, mounting the cup to which the lens is fixed to a cup receiver at a distal end of the one chucking shaft, and allowing a lens presser at a distal end of the other chucking shaft to abut on the lens.

When the periphery of the lens is processed with the processing tool which rotates at high speed, if a load exceeding the holding force of the lens is applied to the lens, rotational deviation may occur between the cup and the lens, and thereby so-called axis deviation may occur. In particular, in a liquid-repellent lens whose surface is coated with a liquid-repellant substance to which water, oil, or the like does not stick easily, the possibility of occurrence of axis deviation is high because the surface slips readily.

SUMMARY OF THE INVENTION

Accordingly, it is an object of the present invention to provide an eyeglass lens processing apparatus capable of appropriately suppressing any axis deviation according to slip conditions of a lens.

In order to solve the object, the present invention is characterized by having the following arrangements.

(1) An eyeglass lens processing apparatus comprising:

a lens rotating unit having lens chucking shafts which hold an eyeglass lens, and a first motor which rotates the chucking shafts;

an axis-to-axis distance changing unit having a second motor which changes an axis-to-axis distance between a center axis of rotation of a processing tool which processes a periphery of the lens and a center axis of rotation of the chucking shafts;

a torque detector which directly or indirectly detects torque transmitted to the chucking shafts;

a torque level setting unit which variably sets an allowable torque level; and a driving controller which controls at least one of driving of the first motor and driving of the second motor to adjust at least one of a rotational speed of the chucking shafts and a processing pressure of the lens so that the detected torque falls below the set allowable torque level.

(2) The eyeglass lens processing apparatus according to (1), wherein the torque level setting unit includes:

a display portion which displays information on the torque which is detected when a load is applied to the lens held by the chucking shafts; and an input portion which variably inputs the allowable torque level.

(3) The eyeglass lens processing apparatus according to (1), wherein the torque level setting unit includes an automatic setting unit which variably sets the allowable torque level on the basis of maximum torque which is detected when a load is applied until axis deviation occurs in the lens held by the chucking shafts.

(4) The eyeglass lens processing apparatus according to (1), wherein the torque level setting unit includes a storage which stores a plurality of allowable torque levels, and a selector which selects a desired torque level among the stored allowable torque levels.

(5) The eyeglass lens processing apparatus according to (1), further comprising a display portion which displays information on the torque detected during processing of the lens.

DESCRIPTION OF THE PREFERRED EMBODIMENTS

Figure 1:
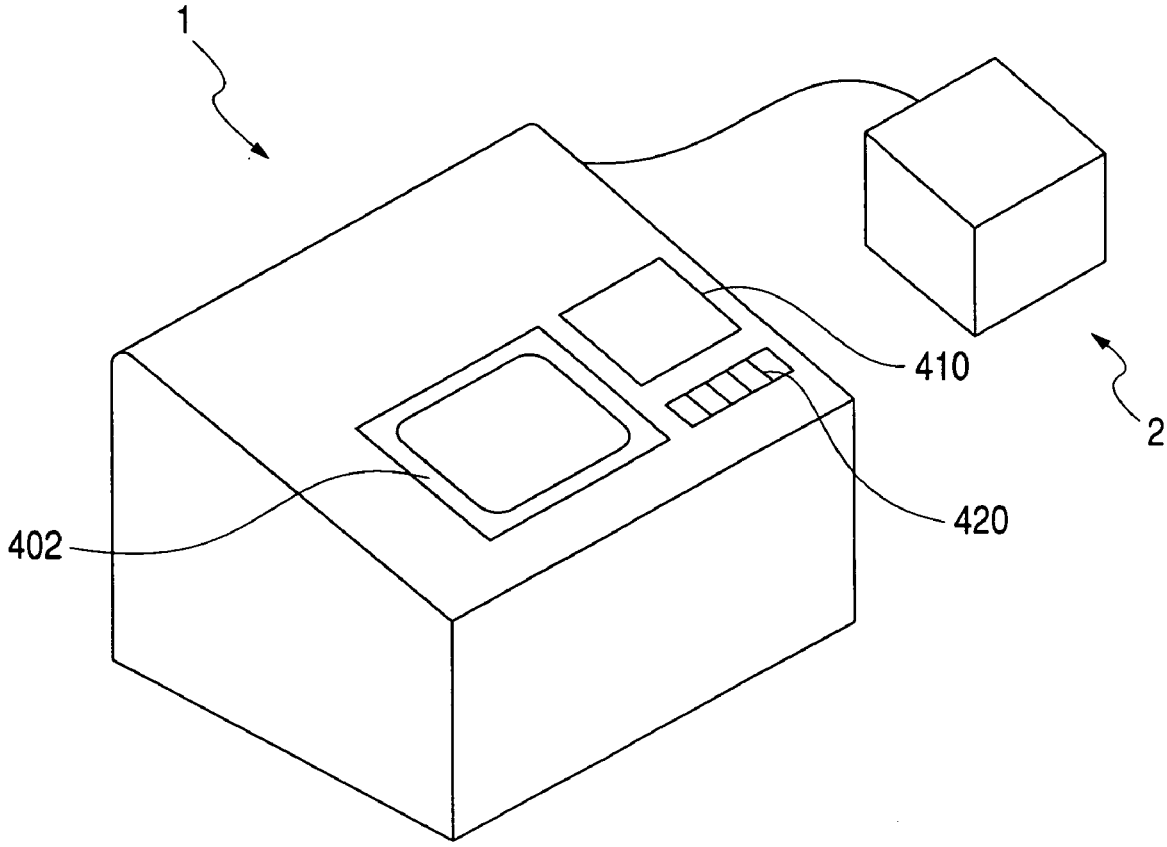
FIG. 1 is a view showing a schematic appearance of an eyeglass lens processing apparatus that is an embodiment of the present invention.

Hereinafter, embodiments according to the present invention will be described with reference to the accompanying drawings. FIG. 1 is a view showing a schematic appearance of an eyeglass lens processing apparatus 1 according to an embodiment of the present invention. An eyeglass frame measuring device 2 is connected to the processing apparatus 1. As the measuring device 2, for example, measuring devices as disclosed in U.S. Pat. No. 5,333,412 (JP-A No. 4-93164), U.S. Re. 35898 (JP-A No. 5-212661, etc. can be used. A touch panel 410 which serves as a display portion which displays processing information, etc. and an input portion which allows an operator to input processing conditions, etc. and a switch portion 420, which has switches for processing instructions, as a processing start switch, are provided on the top of the processing apparatus 1. A lens to be processed is processed in a processing chamber inside an opening/closing window 402. Further, the processing apparatus 1 may be an apparatus which are integrated with the measuring device 2.

Figure 2:
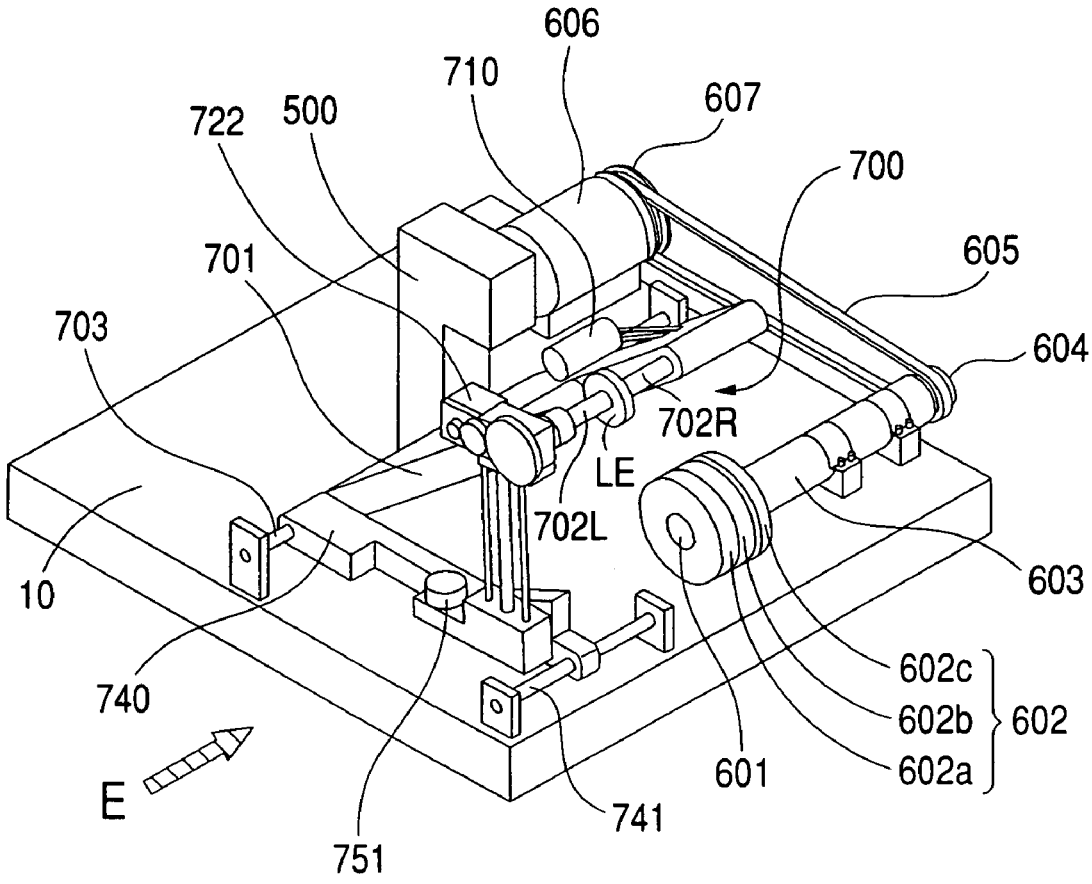
FIG. 2 is a view showing a schematic configuration of a lens processing section.
Figure 3A:
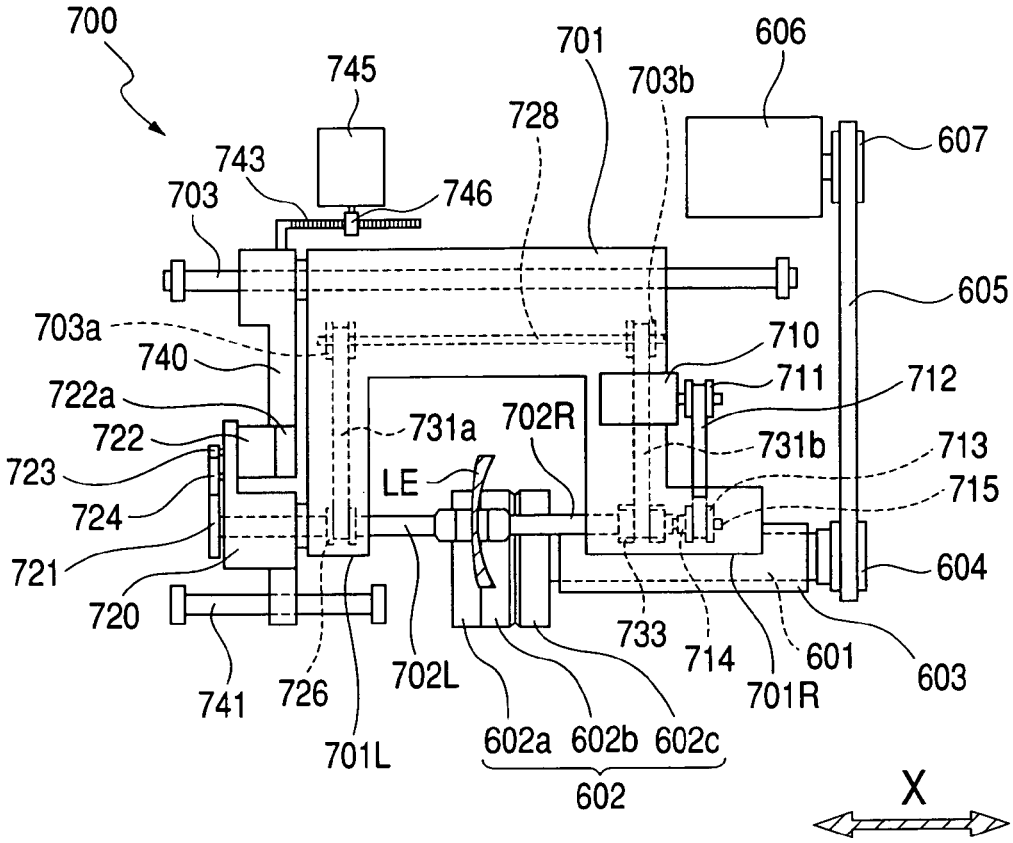
FIGS. 3A and 3B illustrate a schematic configuration of a carriage portion of the lens processing section.
Figure 3B:
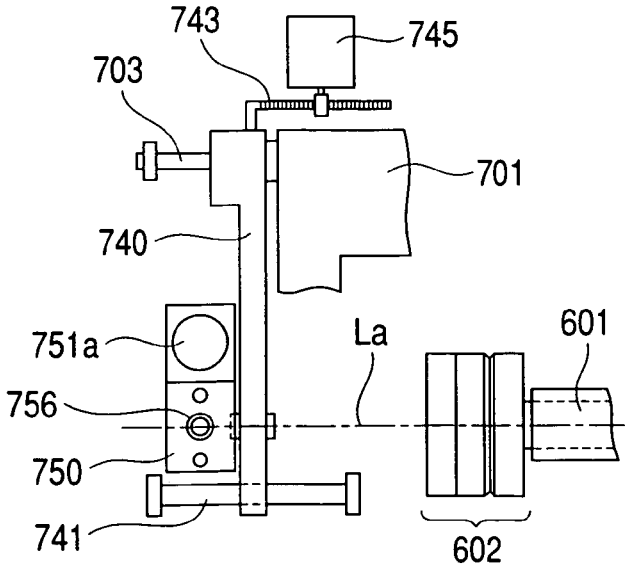
Figure 4:
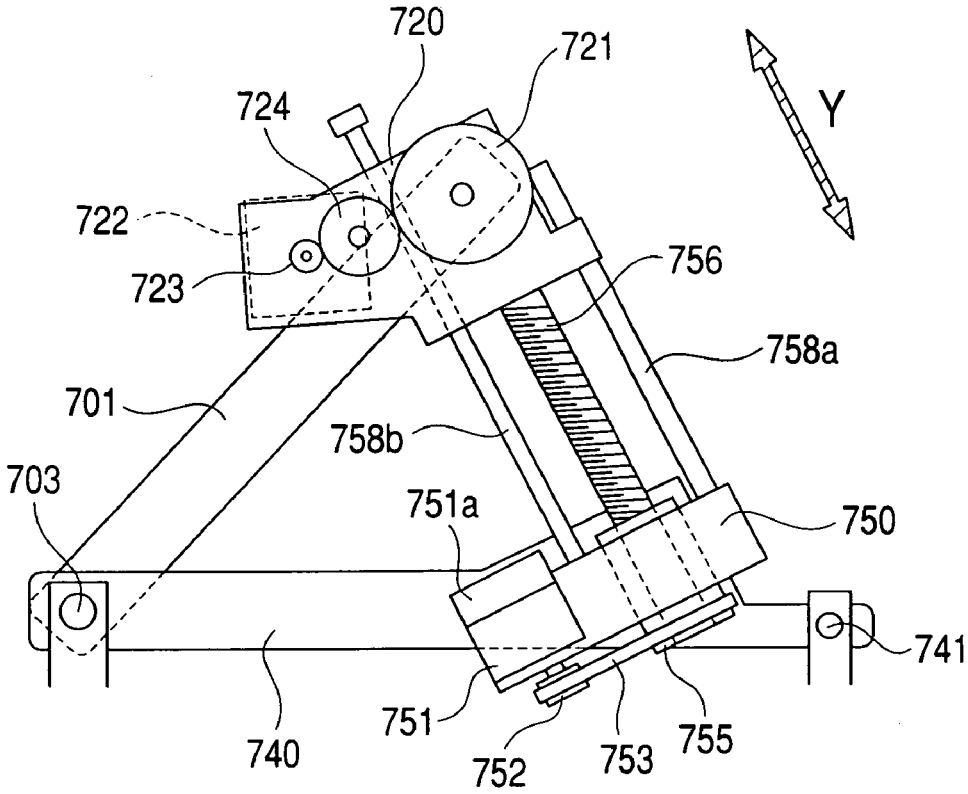
FIG. 4 is a view when the carriage portion in FIG. 2 is seen from a direction E.

FIG. 2 is a view showing a schematic configuration of a lens processing section disposed within a housing of the processing apparatus 1. FIGS. 3A and 3B illustrate a schematic configuration of a carriage portion 700 of the lens processing section. FIG. 4 is a view when the carriage portion 700 in FIG. 2 is seen from a direction E.

The carriage portion 700 including a carriage 701 and its moving mechanism is mounted on a base 10. A lens LE to be processed is rotated while being held (chucked) by chucking shafts 702L and 702R which are rotatably held by the carriage 701, and is ground by a grindstone 602. The grindstone 602 according to the present embodiment includes a roughing grindstone 602*a* for plastic, a roughing grindstone 602*b* for glass, and a bevel-finishing and plane-finishing grindstone 602*c*. A grindstone rotating shaft 601 to which the grindstone 602 is attached is rotatably held by a bearing 603 and is connected to a grindstone rotating motor 606 via a pulley 604 attached to an end of the shaft 601, a belt 605 and a pulley 607 attached to a rotating shaft of the motor 606. Thereby, the rotation of the motor 606 is transmitted to the shaft 601 and the grindstone 602 attached to the shaft 601 is rotated.

A lens shape measuring section 500 is provided at the back side (inner side) of the carriage 701.

The chucking shafts 702L and 702R are held by the carriage 701 so that the central axis of the chucking shafts 702L and 702R (the central axis of rotation of the lens LE) may be parallel to the central axis of the shaft 601 (the central axis of rotation of the grindstone 602). The carriage 701 is movable in the direction of the central axis of the shaft 601 (the direction of the central axis of the chucking shafts 702L and 702R) (X-axis direction). The carriage 701 is also movable in the direction orthogonal to the X-axis direction (the direction in which the axis-to-axis distance between the central axis of the chucking shafts 702L and 702R and the central axis of the shaft 601 changes) (Y-axis direction).

<Lens Holding (Chucking) Mechanism>

Figure 5:
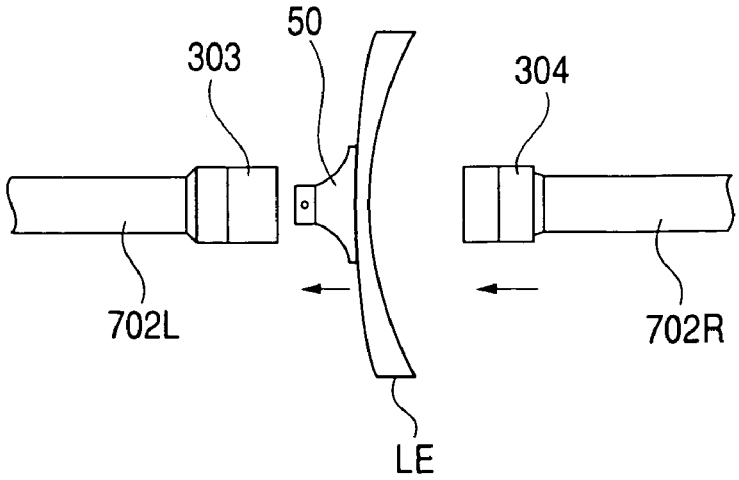
FIG. 5 is a view showing holding (chucking) of a lens by lens chucking shafts.

The chucking shafts 702L and 702R are rotatably and coaxially held by left and right arms 701L and 701R, respectively, of the carriage 701. A cup receiver 303 is attached to a distal end of the chucking shaft 702L, and a lens presser 304 is attached to a distal end of the chucking shaft 702R (refer to FIG. 5). A lens chucking motor 710 is fixed to the right arm 701R. The rotation of the motor 710 is transmitted to a feed screw 715 via a pulley 711 attached to a rotating shaft of the motor 710, a belt 712 and a pulley 713 attached to the feed screw 715, a feed nut 714 screwed to the feed screw 715 is moved in its axial direction, and then the chucking shaft 702R coupled with the feed net 714 is moved in its axial direction. When the lens LE is processed, a cup 50 that is a fixture is attached to the front refractive surface of the lens LE, and a base of the cup 50 is mounted to the cup receiver 303 attached to the chucking shaft 702L as shown in FIG. 5. The cup 50 is preferably of a type that it is attached via a double-sided adhesive tape. The chucking shaft 702R is moved closer to the chucking shaft 702L by the driving of the motor 710, the lens presser 304 attached to the chucking shaft 702R abuts on the rear refractive surface of the lens LE, and the lens LE is held (chucked) by the chucking shafts 702L and 702R.

<Lens Rotating Mechanism>

A lens rotating motor 722 is fixed to a block 720 attached to a left end of the left arm 701L. The rotation of the motor 722 is transmitted to the chucking shaft 702L via a gear 723 attached to a rotating shaft of the motor 722, a gear 724, and a gear 721 attached to the chucking shaft 702L. Further, the rotation of the motor 722 is transmitted to the chucking shaft 702R via a pulley 726 attached to the chucking shaft 702L, a belt 731*a*, a pulley 703*a*, a rotating shaft 728, a pulley 703*b*, a belt 731*b*, and a pulley 733 attached to the chucking shaft 702R. Thereby, the chucking shafts 702L and 702R are rotated in synchronization with each other, and the held (chucked) lens LE is then rotated. Incidentally, a servo motor is used as the motor 722, and its rotating shaft is provided with an encoder 722*a* which detects a rotational angle. The servo motor 722 generates torque when a load is applied to its rotating shaft.

<X-Axis-Direction Moving Mechanism of Carriage 701>

A moving arm 740 coupled with the carriage 701 is supported on guide shafts 703 and 741 fixed parallel to each other on the base 10 so that it is movable in the X-axis direction. Further, a motor 745 for movement in the X-axis direction is fixed onto the base 10. The rotation of the motor 745 is transmitted to the arm 740 via a pinion 746 attached to a rotating shaft of the motor 745, and a rack 743 attached to a rear portion of the arm 740. Thereby, the carriage 701 along with the arm 740 is moved in the X-axis direction.

<Y-Axis-Direction Moving Mechanism of Carriage 701>

As shown in FIG. 3B, a block 750 is attached to the arm 740 so as to be rotatable about an axis La which coincides with the central axis of the shaft 601. Further, the distance from the central axis of the shaft 703 to the axis La, and the distance from the central axis of the shaft 703 to the central axis of the chucking shaft 702L and 702R are set to be equal to each other. A motor 751 for movement in the Y-axis direction is fixed to the block 750. The rotation of the motor 751 is transmitted to a female screw 755, which is rotatably held by the block 750, via a pulley 752 attached to a rotating shaft of the motor 751 and a belt 753. A feed screw 756 meshes with the female screw 755 and is inserted therethrough. The feed screw 756 is moved up and down in the Y-axis direction by the rotation of the female screw 755. An upper end of the feed screw 756 is fixed to the block 720. When the feed screw 756 is moved up and down by driving the motor 751, the block 720 is moved up and down in the Y-axis direction-along guide shafts 758*a* and 758*b*, and the carriage 701 to which the block 720 is attached is also changed in its up-and-down position (Y-axis-direction position). That is, the carriage 701 is turned about the shaft 703 as its rotation center, and then the axis-to-axis distance between the chucking shafts 702L and 702R and the shaft 601 is changed. The processing pressure of the lens LE (the pressing pressure of the lens against the grindstone 602) is generated by the control of torque of the motor 751. The torque of the motor 751 is adjusted by a voltage applied to the motor 751, and thereby the processing pressure is also adjusted. In addition, in order to reduce downward load of the carriage 701, it is preferable that a compression spring, etc. is provided between the left arm 701L and the arm 740. Further, as a mechanism for adjusting processing pressure, a spring which pulls the carriage 701 in a direction in which it approaches the grindstone 602, and a mechanism which changes the force of the spring may be used. Incidentally, a servo motor is used as the motor 751, and its rotating shaft is provided with an encoder 751*a* which detects a rotational angle.

Figure 6:
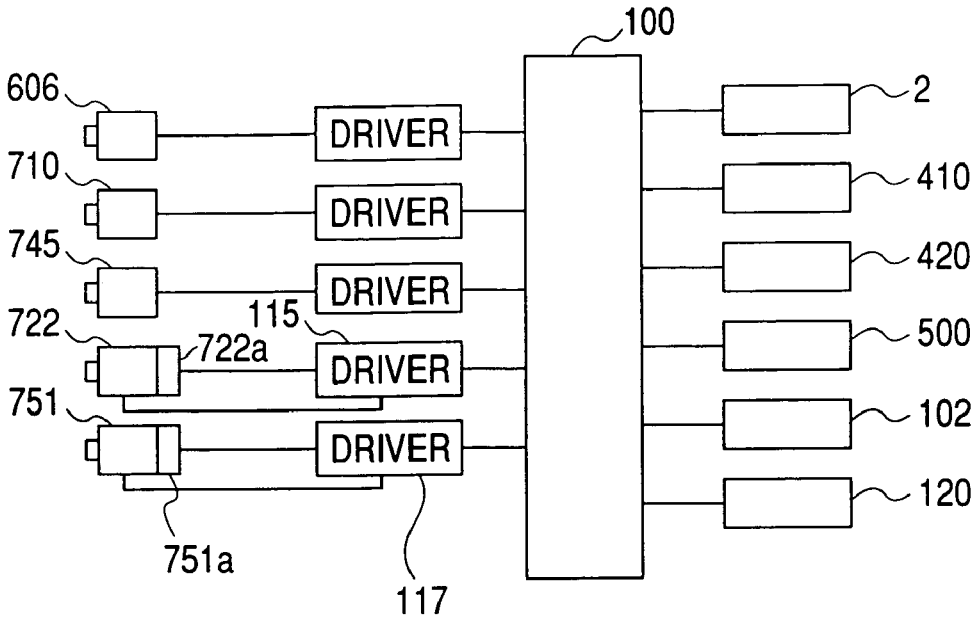
FIG. 6 is a schematic block diagram of a control system of the present apparatus.

Next, the operation of the present apparatus will be described with reference to a schematic block diagram of a control system of the present apparatus in FIG. 6.

A target lens shape of a rim of an eyeglass frame, etc. is measured by the measuring device 2, and the obtained target lens shape data is input by manipulation of the panel 410. Since the input target lens shape data is stored in a memory 120, and a target lens shape graphic based on the target lens shape data is displayed on a screen of the panel 410, layout data on a wearer of the eyeglass frame is input by the manipulation of the panel 410. If required input is performed, the lens LE is held (chucked) by the chucking shafts 702L and 702R.

If the processing start switch of the switch portion 420 is pushed, an arithmetic control portion 100 calculates vector information (rδn, rθn) of the target lens shape data with the holding (chucking) center of the lens LE being the processing center, on the basis of the input layout data (rδn is vector length, and rθn is vector angle). Further, the arithmetic control portion 100 calculates a processing point for every rotational angle of the lens LE on the basis of the obtained vector information and the radius R of the grindstone 602, and calculates the axis-to-axis distance L between the center axis of the chucking shafts 702L and 702R and the center axis of the shaft 601 at the processing point.

For example, the vector information (rδn, rθn) (n=1, 2, 3, . . . , and N) is substituted into the following Formula 1 to obtain a maximum value Li of the distance L, and this maximum distance Li is obtained for a predetermined rotational angle ξi. If the vector angle rθn of each distance Li is defined as Θi, this (ξi, Li, Θi) (i=1, 2, . . . , and N) becomes the target lens shape data related to the distance L, and is stored in the memory 102.

$$L = r\delta n \cdot \cos r\delta n + \sqrt{R^2 - (r\delta n \cdot \sin r\Theta n)^2} \quad (n = 1, 2, 3, \ldots, N) \qquad \text{Formula 1}$$

Next, on the basis of this target lens shape data, the arithmetic control portion 100 makes the lens shape measuring section 500 perform measurement of the front refractive surface and the rear refractive surface of the lens LE. Then, on the basis of the obtained shape of the lens LE, the arithmetic control portion 100 calculates roughing data and finishing data.

If the lens LE is a plastic lens, the arithmetic control portion 100 controls the driving of the motor 45 to move the carriage 701 in the X-axis direction and locate the lens LE on the roughing grindstone 602*a*. Next, the arithmetic control portion 100 controls the driving of the motor 722 via a driver 115 to rotate the lens LE, and the driving of the motor 751 via a driver 117 to move the carriage 701 in the Y-axis direction to perform roughing such that the lens LE is pressed against the rotating roughing grindstone 602*a* on the basis of the roughing data. The rotational angle of the lens LE (the chucking shafts 702L and 702R) is detected by the encoder 722*a*. Further, the axis-to-axis distance between the chucking shafts 702L and 702R and the shaft 601 which indicates a movement position of the carriage 701 in the Y-axis direction is detected by the encoder 751*a*.

Figure 7:
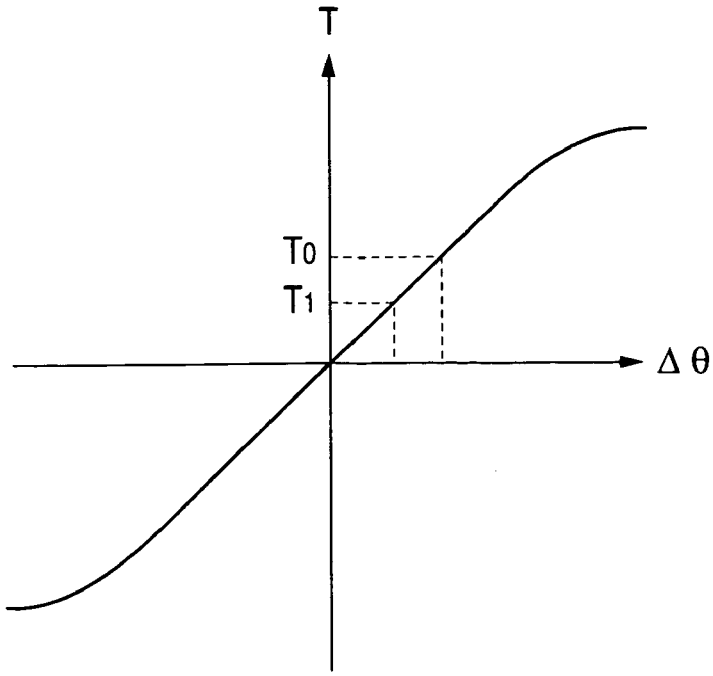
FIG. 7 is a view showing the relationship between a rotational angle error $\Delta\theta$ and torque T.

During processing of the lens LE, if an excessive load above the holding force of the chucking shafts 702L and 702R is applied to the lens LE, axis deviation may occur between the cup 50 and the lens LE. A command pulse signal for rotating the lens LE at every rotational angle is send to the motor 722. Simultaneously, the rotational angle of the rotating shaft of the motor 722 is detected by the encoder 722*a*. In the driver 115, the rotation command pulse signal to the motor 722 is compared with the rotation detection pulse signal from the encoder 722*a*. Here, if there is any deviation between both, a voltage applied to the motor 722 (a current flowing through the motor 722) is changed in order to cancel this deviation. By such feedback control, if a load caused by the processing is applied to the rotating shaft of the motor 722, the motor 722 increases torque to return the rotational angle to a commanded rotational angle. The torque T at this time, as shown in FIG. 7, is in a relation approximately proportional to the rotational angle error Δθ (an error between the rotation instruction pulse signal to the motor 722 and the rotation detection pulse signal from the encoder 722*a*). Accordingly, the torque T of the motor 722 is indirectly obtained from the rotational angle error Δθ.

If the torque T exceeds an allowable torque level T0 (a torque level required to hold the lens LE without any axis deviation) of the lens LE, the arithmetic control portion 100 controls the driving of the motor 722 to reduce the torque and reduce the rotational speed of the lens LE (also including stopping the rotation of the lens LE). Otherwise, the arithmetic control portion controls the driving of the motor 751 for moving the carriage 701 in the Y-axis direction to reduce the torque and reduce the processing pressure of the lens LE (also including pulling the lens LE away from the grindstone 602). The torque of the motor 751 can be detected from a current flowing through the motor 751 to be detected by a current detecting circuit possessed by the driver 117. Further, similar to the torque T of the motor 722, the torque of the motor 751 can also be detected on the basis a rotation instruction pulse signal to the motor 751 and a rotation detection pulse signal from the encoder 751*a*. Incidentally, the allowable torque level T0 is stored in advance as a torque level which does not cause any axis deviation between the cup 50 and the lens LE.

If the torque T of the motor 722 falls below a torque level T1 (which is set on the basis of the allowable torque level T0) of the torque-up allowance which is set to be lower than the allowable torque level T0, the arithmetic control portion 100 controls the driving of the motors 722 and 751 via the drivers 115 and 117 in order to perform normal processing again. In this way, if the torque T of the motor 722 exceeds the allowable torque level T0, at least one of the rotational speed and the processing pressure of the lens LE is adjusted so that the torque T falls below the allowable torque level T0. As a result, a load acting on the lens LE is reduced and thus any axis deviation of the lens LE is suppressed.

When the roughing is completed, the arithmetic control portion 100 moves the carriage 701 in the X-axis direction and locates the lens LE on the grindstone 602*c*, and controls the rotation of the lens LE and the movement of the carriage 701 in the X-axis direction and the Y-axis direction on the basis of the finishing data, thereby performing finishing of the lens LE. During this finishing, the arithmetic control portion 100 also controls the driving of at least one of the motors 722 and 751 so that the torque T of the motor 722 falls below the allowable torque level T0.

Incidentally, as a method of detecting the torque T transmitted to the chucking shafts 702L and 702R, the rotational angle error Δθ (an error between the rotation instruction pulse signal to the motor 722 and the rotation detection pulse signal from the encoder 722*a*) is used in the above embodiment. However, a method of detecting the torque by directly providing at least one of the chucking shafts 702L and 702R with a torque sensor may be used naturally.

Further, as the method of making the torque T transmitted to the chucking shafts 702L and 702R fall below the allowable torque level T0, a method of setting a limit value to a current through the motor 722 and controlling the motor 722 below the limit value may be used. The current flowing through the motor 722 is detected by a current detecting circuit possessed by the driver 115. Since the torque T of the motor 722, that is, the torque T transmitted to the chucking shafts 702L and 702R, and the current flowing through the motor 722 are in a relation approximately proportional to each other, the torque T transmitted to the chucking shafts 702L and 702R can also be indirectly detected by detecting the current flowing through the motor 722. The limit value of the current flowing through the motor 722 is determined on the basis of the relation to the allowable torque level T0 which does not causes any axis deviation between the cup 50 and the lens LE.

Incidentally, although the apparatus of the present embodiment is an apparatus for processing the lens LE as the chucking shafts 702L and 702R is moved with respect to the shaft 601 (the lens LE is moved with respect to the grindstone 602), an apparatus which processes the lens LE as the shaft 601 is moved with respect to the chucking shafts 702L and 702R (the grindstone 602 is moved with respect to the lens LE) may be adopted. In this case, the driving of a motor which moves the shaft 601 may be controlled to adjust the processing pressure. Further, an apparatus in which a lens is simultaneously processed by a plurality of grindstones may be adopted. Further, although a grindstone is used for the apparatus of the present embodiment as a tool for processing a lens, well-known processing tools which rotates a cutter, etc. to perform grinding or cutting may be used.

Next, the setting of the allowable torque level T0 according to slip conditions of the lens LE will be described. A lens coated with a liquid-repellant substance (hereinafter referred to a liquid-repellant lens), slips very easily as compared with common lenses, and its slip conditions are various. Further, the slip conditions vary depending on the size of the holding portion (abutting portion) of the cup 50, the adhesive force of an adhesive tape, or the like. If the allowable torque level T0 is made constant so as to be suitable for a slippery lens, as described above, the processing pressure, etc. is controlled so that it falls below the allowable torque level T0. Thus, the processing time may become long. Conversely, if priority is given to the processing time and the allowable torque level T0 is consequently made excessively high, axis deviation may be apt to occur in a slippery lens.

Thus, the setting of the allowable torque level T0 is performed in the following manner according to lenses.

First, the cup 50 is fixedly attached to the front refractive surface of the liquid-repellant lens LE. For example, the cup 50 is fixed to the front refractive surface of the lens LE with an adhesive sheet and an adhesive tape therebetween. Incidentally, an adhesive sheet may also be adhered to the rear refractive surface of the lens LE. Thereby, the holding force by the lens presser 304 increases.

Figure 8:
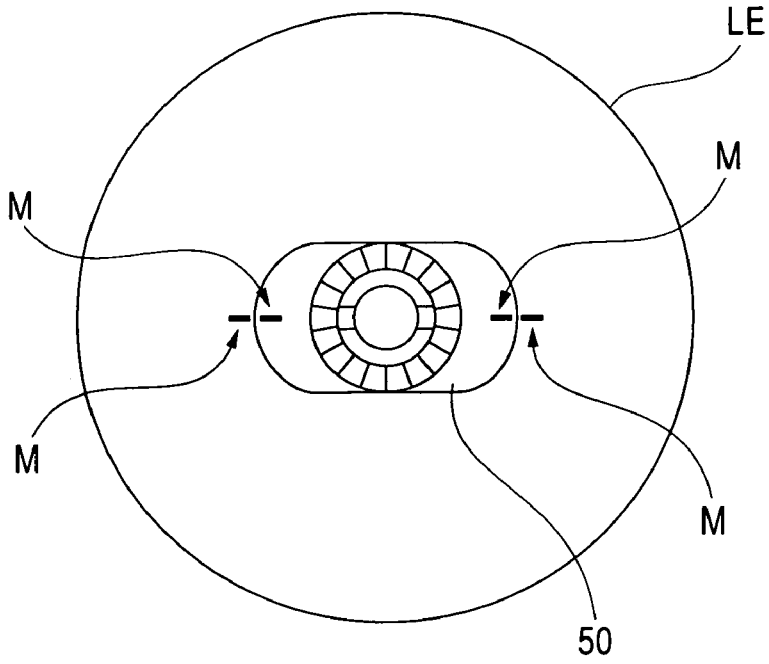
FIG. 8 is a view showing a cup fixed to a front refractive surface of a lens LE and an axis deviation confirmation mark.

When the cup 50 is fixed to the front refractive surface of the lens LE, as shown in FIG. 8, marks M for confirmation of axis deviation, such as ink and seal, which can be removed later, are attached to the cup 50 and the lens LE. For example, the marks M are attached in a line so that an operator can recognize any rotational deviation of the lens LE with respect to the cup 50.

Figure 9:
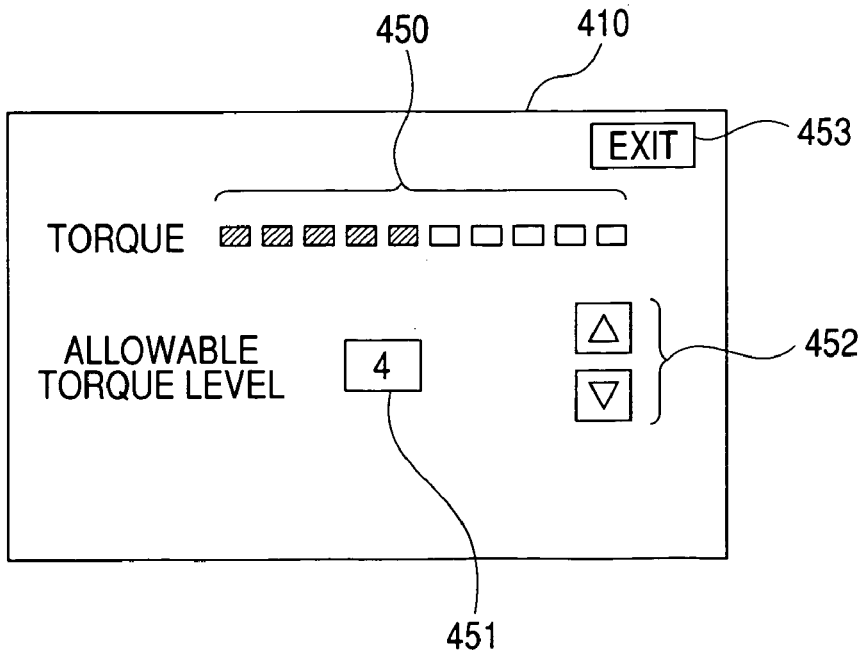
FIG. 9 is a view an exemplary setting screen of an allowable torque level.

Next, the base of the cup 50 fixed to the lens LE is mounted to the cup receiver 303, the chucking shaft 702R is moved in a direction in which it approaches the chucking shaft 702L by the operation of the switch portion 420, and the lens LE is held (chucked) by the chucking shafts 702L and 702R. Further, a setting screen which allows setting of the allowable torque level T0 is displayed by the operation of a menu key of the panel 410. FIG. 9 shows an example of the setting screen. An indicator 450 indicates the torque T transmitted to the chucking shafts 702L and 702R detected on the basis of the rotational angle error $\Delta\theta$, for examples, indicates ten levels of torque. In this way, the panel 410 serves as a display portion which displays the information of the detected torque T and an input portion for variably setting the allowable torque level T0.

When the lens LE held (chucked) by the chucking shafts 702L and 702R is rotated and a load is applied to the lens LE, similar to during the processing, the torque of the motor 722 increases, and the rotational angle of the rotating shaft of the motor 722 returns to an instructed rotational angle. The torque T at this time is displayed by the indicator 450. When the lens LE is further rotated manually and a load is applied to the lens LE, axis deviation occurs in the lens LE. Occurrence of the axis deviation can be confirmed with the marks M. Further, the axis deviation can also be grasped to a certain degree by the sense of touch of a hand. A limit torque level when any axis deviation has occurred is confirmed with the indicator 450, and the allowable torque level T0 is set (changed) to a level lower (for example, by one or two levels) than the limit torque level. When the allowable torque level T0 has been set, the screen of the panel 410 is returned to an initial processing screen of the panel 410 by the operation of an EXIT key 453, and simultaneously, the allowable torque level T0 stored in the memory is changed (updated).

Incidentally, the variable setting of the allowable torque level T0 may be performed in the following manner. For example, a load may be applied until the lens LE is manually rotated and maximum torque at that time the axis deviation occurs is stored in the arithmetic control portion 100. In this case, by the operation of a setting key which is not shown, the arithmetic control portion 100 automatically sets (changes) a level lower by a predetermined amount (by predetermined levels) than the stored maximum torque as the allowable torque level T0.

Before the processing of the lens LE, the allowable torque level T0 is set, the cup 50 is re-fixed to the lens LE, and processing is carried out. Since the allowable torque level T0 is determined in advance according to the slip conditions of the lens LE, any axis deviation can be suppressed, and processing can be performed efficiently. Further, since the processing pressure, which suppresses axis deviation according to the slip conditions of the lens LE, can be appropriately adjusted, an adhesive sheet required for fixation of the liquid-repellant lens to the cup 50 can be omitted in some cases.

Incidentally, a load applied to the lens LE can be confirmed even during processing by making the indicator 450 displayed on the screen of the panel 410 during processing. For example, the torque T detected during processing is displayed with lengths of the indicator 450. Display colors of the indicator 450 can be varied when the torque T falls below the allowable torque level T0, when the torque T is almost the same as the allowable torque level T0, or when the torque T exceeds the allowable torque level T0. As a result, suitability of the setting of the allowable torque level T0, possibility of axis deviation of the lens LE during processing, etc. can be grasped easily.

Further, the setting of an allowable torque level does not need to be performed with every processing. For example, the setting can be performed as an occasion arises, such as when slip conditions are unclear in new kinds of lenses, when the cup 50, the adhesive tape, or the like is changed, or the like. Further, since the kind of the liquid-repellant lens is generally known to a certain degree, a normal processing pressure mode not for a liquid-repellant lens but mainly for a common lens, a soft processing pressure rode mainly for a liquid-repellant lens, or the like (a plurality of modes are prepared according to slip conditions of lenses) can be selected by the panel 410. Among allowable torque levels corresponding to individual modes stored in the memory 102, an allowable torque level corresponding to a selected mode may be set.

What is claimed is:

1. An eyeglass lens processing apparatus comprising:

a lens rotating unit having lens chucking shafts which hold an eyeglass lens, and a first motor which rotates the chucking shafts;

an axis-to-axis distance changing unit having a second motor which changes an axis-to-axis distance between a center axis of rotation of a processing tool which processes a periphery of the lens and a center axis of rotation of the chucking shafts;

a torque detector which directly or indirectly detects torque transmitted to the chucking shafts;

a torque level setting unit which variably sets an allowable torque level; and a driving controller which controls at least one of driving of the first motor and driving of the second motor to adjust at least one of a rotational speed of the chucking shafts and a processing pressure of the lens so that the detected torque falls below the set allowable torque level.

2. The eyeglass lens processing apparatus according to claim 1, wherein the torque level setting unit includes:

a display portion which displays information on the torque which is detected when a load is applied to the lens held by the chucking shafts; and an input portion which variably inputs the allowable torque level.

3. The eyeglass lens processing apparatus according to claim 1, wherein the torque level setting unit includes an automatic setting unit which variably sets the allowable torque level on the basis of maximum torque which is detected when a load is applied until axis deviation occurs in the lens held by the chucking shafts.

4. The eyeglass lens processing apparatus according to claim 1, wherein the torque level setting unit includes a storage which stores a plurality of allowable torque levels, and a selector which selects a desired torque level among the stored allowable torque levels.

5. The eyeglass lens processing apparatus according to claim 1, further comprising a display portion which displays information on the torque detected during processing of the lens.

* * * * *